United States Patent [19]

Grommes et al.

[11] Patent Number: 5,054,396

[45] Date of Patent: Oct. 8, 1991

[54] FUSE ELEMENT, PREFERABLY WITH LONG DELAY PERIOD AND METHOD FOR PRODUCING THE SAME

[75] Inventors: Peter-Josef Grommes; Hans Florin, both of Troisdorf; Günther Faber, Siegburg; Peter Röh, Troisdorf, all of Fed. Rep. of Germany

[73] Assignee: Dynamit Nobel Aktiengesellschaft, Troisdorf, Fed. Rep. of Germany

[21] Appl. No.: 553,302

[22] Filed: Jul. 17, 1990

Related U.S. Application Data

[63] Continuation-in-part of Ser. No. 293,470, Jan. 4, 1989, abandoned.

[30] Foreign Application Priority Data

Jan. 9, 1988 [DE] Fed. Rep. of Germany ..... 3800455

[51] Int. Cl.[5] ..... F42C 19/08; F42C 19/10

[52] U.S. Cl. ..... 102/204; 102/202.13; 102/275.3

[58] Field of Search ..... 86/10, 20.1, 24, 25, 86/30; 102/204, 286, 202.13, 275.13

[56] References Cited

U.S. PATENT DOCUMENTS

| | | | |
|---|---|---|---|
| 2,560,452 | 7/1951 | Kerr et al. | 102/202.13 |
| 2,717,204 | 9/1955 | Noddin et al. | 102/202.13 |
| 3,173,366 | 3/1965 | Bossard | 102/202.13 |
| 3,372,643 | 3/1968 | Kvovle | 102/204 |
| 3,688,702 | 9/1972 | Prior et al. | 102/204 |
| 4,335,652 | 6/1982 | Bryon | 102/275.3 |
| 4,386,567 | 6/1983 | Ciccone et al. | 102/204 |
| 4,455,914 | 6/1984 | Christmann et al. | 86/20.1 |
| 4,760,792 | 8/1988 | Dumas et al. | 102/204 |

*Primary Examiner*—David H. Brown

*Attorney, Agent, or Firm*—Antonelli, Terry, Stout & Kraus

[57] ABSTRACT

In fuse elements of layered structure with long delay times, misfires, occur, above all, if aggravating secondary conditions prevail (such as, for example, high projectile rotation and/or temperature stresses and shock stresses). The safe progression of the reaction through the element is enhanced by providing that, as seen in the propagation direction of the reaction, the central zone of a charge igniting a delay charge projects into a central region of the delay charge. An additional improvement can be achieved by interposing between the ignition charge and the delay section, one or several relay charges and by making the choice of the charge components so that the discontinuities of the characteristic values (especially of the reaction rate) become more even and thus smaller, or by utilizing an ignition charge having a particularly low reaction rate.

2 Claims, 1 Drawing Sheet

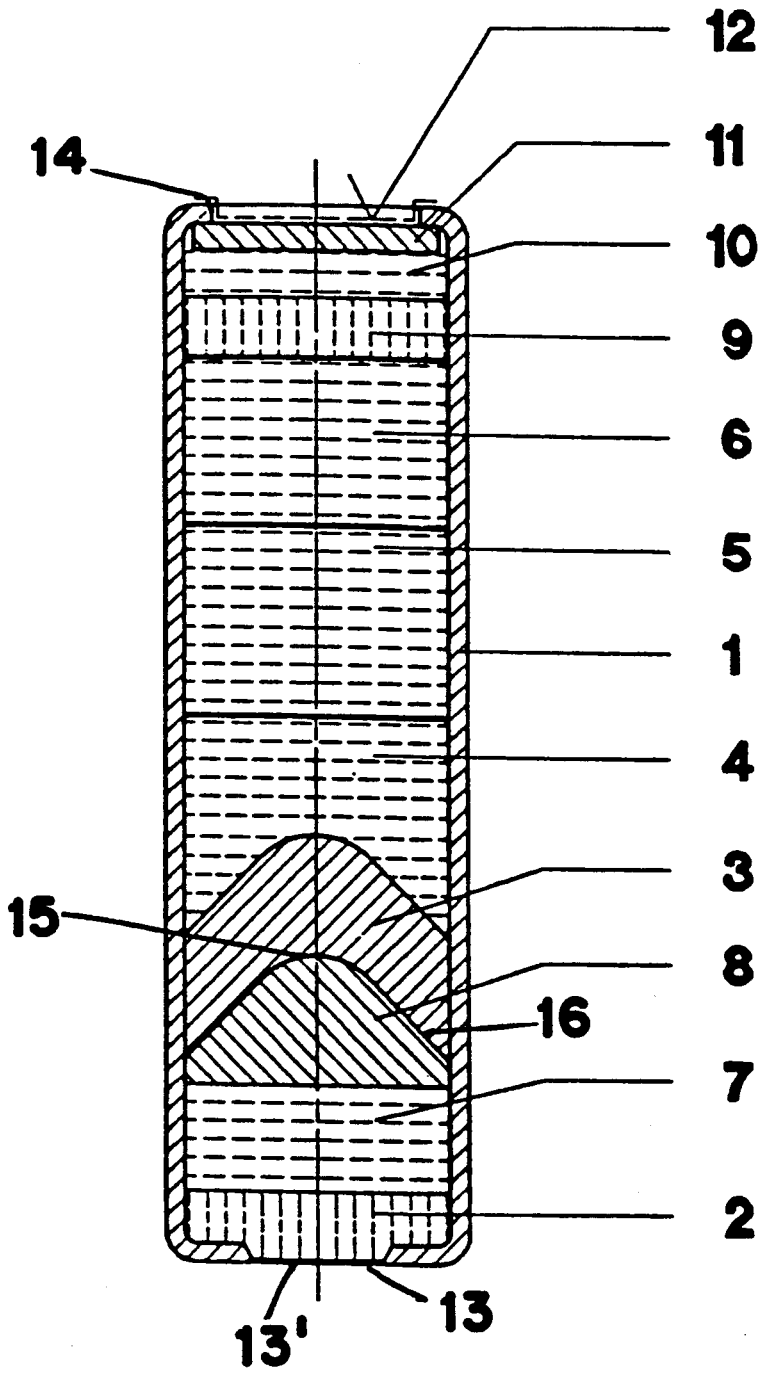
12
11
14
10
9
6
5
1
4
3
15
8
16
7
2
13
13'

FUSE ELEMENT, PREFERABLY WITH LONG DELAY PERIOD AND METHOD FOR PRODUCING THE SAME

CROSS REFERENCE TO RELATED APPLICATION

This application is a Continuation-In-Part of U.S. patent application Ser. No. 293,470, now abandoned, entitled "Fuse Element, Preferably With Long Delay Period", filed Jan. 4, 1989. (The aforementioned application is incorporated herein by reference in its entirety.)

BACKGROUND OF THE INVENTION

This invention is directed to a fuse element or detonator containing, in a cylindrical-symmetric arrangement and layered, in succession, an igniter charge, a delay section made up of one or several delay charges, and a detonative or flash yielding charge layer and a method of producing this element or detonator.

A fuse element with a delay section serves the purpose of enhancing the pyrotechnical reaction produced upon triggering of a detonator composition in such a way that this reaction, after a delay period, leads to the sure detonation or ignition of a primary charge, usually within the fuse element.

A fuse element is built up of several, series-arranged pyrotechnical charges: the highly sensitive but weak triggering of an igniter charge is to be utilized, after a predetermined period of time, for the sure ignition of a primary charge. The weak points of a fuse element where passage of the reaction zone can be disturbed or interrupted are the areas where pyrotechnical compositions having differing physical and chemical properties abut or contact one another. At such interfaces, the reaction process ceases, above all, if progression of the reaction is made difficult by other additional conditions, such as, for example, by a very high rotation of the fuse element, by low temperatures, by vibrations, impacts, shocks, and the like.

Also, the requirement of long delay periods normally is accompanied by a decrease in reliability, because the delay charges suitable for this purpose have such a chemical composition that the desired gradual transmission takes place with certainty only with optimum initiation of the reaction in the delay section.

SUMMARY OF THE INVENTION

The invention is based on the object to ensure progression of the reaction through the detonator zone in a fuse element with even greater certainty, even under aggravated external conditions.

This object has been attained by providing that the central zone of a charge igniting the delay section projects into a first delay charge of the delay section.

The basic aspect of the invention resides in improving the transition between the igniter charge and the delay charge. The geometrical configuration of the charge igniting the (first) delay charge supplies the greatest contribution toward increasing the reliability. In this context, the composition igniting the delay section either is initially a gradually deflagrating igniter charge, or, in an especially preferred manner, one or several relay charges are present between an igniter charge and the delay section, at least the central zone of the charge igniting the delay section projecting into the (first) delay charge.

Jump-like changes in physical properties are encountered between the charges, built up in layers, in a fuse element; in particular, the reaction rate fluctuates very considerably: in a highly sensitive igniter charge, this reaction rate can be on the order of 500 mm/s; in the delay charge, the propagation velocity or reaction rate ranges from 0.6 to 1.5 mm/s; in relay charges interposed therebetween, this rate is usually between 30 and 200 mm/s. It has been found that transmitting the reaction process can lead to difficulties, above all, at those interfaces where the reaction rate of the delay charge is no longer so high, i.e. the propagation velocity of the reaction wave is already relatively low, so that disturbances are encountered especially at the transition to the delay charge. In accordance with the present invention, if the central zone of the relay charge igniting the delay section bulges into the first delay charge, then the increase in reliability is maximally pronounced.

The central bulging of the charge igniting the delay section is preferably conical; however, this bulge can also correspond preferably to an area of a spherical segment. This bulge is determined by the tool used for pressing the igniter charge into the cylindrical casing. In this connection, it has been found that it can be especially advantageous from a technical viewpoint if the central area zone has spherically rounded surface and the lateral zones have surfaces that are similar to a truncated cone.

The configuration of the transition between the charge igniting the delay section and the first delay charge according to this invention is not only based on the aforedescribed geometrical form but also depends decisively on the provision that the curved interface extends across the entire cross section of the element. In French Patent No. 2,151,495, for example, the igniter charge of the propellant charge for a rocket engine is also conical, inter alia, but the interface between the igniter charge and the propellant grain does not cover the entire cross section of the propellant charge. In the fuse element according to this invention, such a geometry of the interface would not result in reliable functioning—transmission of the reaction of the relay charge to the delay charge.

In contrast to French Patent 2,151,495, in the fuse element of the invention, the igniter charge must first be introduced from the rear (flame or detonator exit end) into the cylindrical casing of the fuse element, and thereafter, the relay charges followed by the delay charges and the primary charge; in this process, the relay charge and the delay charge are compacted by means of a pressure pin having a concave pressure area. Only due to this actually unusual manufacturing process is the reliable reaction transmission obtained from the igniter charge to the delay charge.

A certain dependency on the wall thickness and on the diameter of the fuse element has also been observed. It is especially advantageous to make the cross section of the charges maximally large and/or to make the wall thickness of the casing of the fuse element maximally thin. This dependency is mitigated by the feature that the central zone of the charge igniting the delay section projects into the (first) delay charge.

Still further measures can be taken to support the reshaping, according to this invention, of the transitional zone between the charge igniting the delay section and the (first) delay charge, the "most difficult" site within a fuse element where failures occur, above all, in case further aggravating additional demands, such as high spin, for example, are posed. Such an advantageous embodiment of the fuse element according to this invention is, for example, provided by a subdivision of the relay charge into two (or more) charges whereby it becomes possible to reduce the relatively great discontinuities in the reaction rate in the igniter charge and in the delay charge. The selection of materials for the subdivided relay charges is essentially effected under the viewpoint to reduce the jumps or abrupt changes in physical characteristics at the interfaces. Such a measure increases the reliability of the fuse element. Subdivision of the relay charge into two or more charges, with properties changing with lesser discontinuity, can furthermore make it possible for the delay charge to exhibit properties that actually are even more desirable, such as, for example, a still slower reaction rate; whereas, such a material for the delay charge would not have been usable heretofore because otherwise the transition from the igniter charge to the delay charge would have become even more problematic (because it would have been too abrupt).

A further improvement is obtained by also changing the otherwise known, planar-parallel transition zones between the individual delay charges. In this connection, a change in the area between the first and second delay charges is especially preferred. The individual delay charges normally are identical in chemical and physical respects. The delay section is subdivided into several delay charges primarily for the reasons of manufacturing technology. There is practically no additional expense involved in also making the side of the first delay charge that is at the front in the detonation direction into a bulge, which can be done with the same tool. With this feature, an additional improvement in reliability is observed.

In the accompanying drawing, the sole figure shows a longitudinal sectional view of a fuse element with detonative outlet.

DETAILED DESCRIPTION OF THE INVENTION

The invention is illustrated in the drawing and will be described in detail by way of example.

The fuse element consists of a cylindrical one-piece casing 1 having an outer diameter of 5 mm and a length of 17 mm. In one embodiment the casing has openings 13,14 at both ends. In the preferred embodiment, the top or discharge end is open and the bottom is closed, i.e. the bottom area is machined to have a foil-like zone with a thickness of from about 30–80 μm. As seen in the direction of progression of the detonation zone provided within the casing (in the drawing from the bottom toward the top), the first igniter or ignition layer 2 consists of a sensitive friction charge (e.g. a mixture of lead styphnate, tetrazene, lead azide, barium nitrate, antimony sulfide) of high reaction rate, which can be ignited by a puncture needle or like impacting element (not shown), and wherein the reaction progresses at a velocity of about 500 mm/s upwardly to the next successive layer.

The fuse element is designed for operating over relatively long periods (on the order of 10 seconds). In the delay section, the reaction rate is about 1 mm/s. On account of manufacturing technology, the delay charge forming the delay section, consists of four chemically and physically identical charges (e.g. mixture of W/Ba-$CrO_4$/$KClO_4$), 3, 4, 5, 6. The whole length of the delay column is about 10 mm. The delay composition is compressed with a pressure of about 500 bars. The relay section, arranged before the delay section, consists of two charges (e.g. mixtures of silicon and red lead) 7, 8 differing from each other in their ratios of components and their velocities of about 200 mm/s and 50 mm/s and adapted to each other so that the discontinuities of the characteristic values at the boundary or interface surfaces are at a minimum.

In this example, use is made twice at the transition between the charges of the configuration, according to this invention, of a curved transitional zone and/or of a curved bottom surface of the customarily cylindrical charges with planar contact or boundary surfaces. The upper surface of the relay charge 8 has a central zone that is rounded or spherical and lateral sides or zones that are conical or tapered toward the central zone; whereas, the bottom surface of charge 8 is planar or flat. The first delay charge 3 is provided with a bottom surface that mates with the upper surface of charge 8; whereas, the upper surface of charge 3 also has a bulged out configuration, corresponding to that provided by the upper surface of charge 8, which extends into the next successive charge 4. The contact area between the relay charge 8 and the first delay charge 3 is considered the most important transition zone. Moreover, the transition zone from the first delay charge 3 to the second delay charge 4 also exhibits the same shape. This second transitional bulge actually is not absolutely necessary, on account of the same composition of charges 3 and 4. Advantageously, however, with this arrangement during the compacting of the forward element surfaces, an even better connection is also obtained between the delay charge 3 and the relay charge 8.

The final delay charge 6 is followed by a lead azide charge 9, and superjacent to the azide charge 9 there is a PETN charge 10 covered by an aluminum shim or foil 11. The last layer 12 consists of a sealing varnish of nitrocellulose.

Heretofore, cessation of the reaction has been observed time and again in a fuse element having such long delay periods of about 13 seconds, installed in ammunition revolving at 12,000 rpm and higher. Such failures have no longer been in evidence by using fuse elements of this invention as illustrated in the accompanying figure, even at rotational speeds of 17,000 rpm. Also, susceptibility to shocks and low temperatures up to the order of −50° C. is conspicuously reduced herein. In accordance with the method of the present invention, at least one igniter charge and a delay section having at least one delay charge are arranged in layers in a cylindrical casing with a relay charge preferably provided between the igniter charge and the delay section, the front end of the casing has a detonating or flame producing outlet and starting from the front end, first the igniter charge is pressed against the rear end of the casing and then the additional charges, i.e. the relay charges, the delay charges and the detonating charges, are pressed into the casing through the front end, the pressing of a charge that ignites a delay charge being effected with a compression tool or pin having a concave pressing surface in such a manner that this igniting charge, e.g., a relay charge, extends with its central portion into a first delay charge making up the delay section.

Advantageously, the pressure force of the compression applied to the individual charges decreases from the rear end 13 toward the front end 14 of the casing 1, i.e. the pressure force is highest for the igniter charge 2 and lowest for the charge 10. In general the pressure forces are as follows:

Ignition charge—approx. 2,000 to 5,000 bars
Relay charges—approx. 700 to 1,000 bars
Delay charges—approx. 420 to 600 bars
Charges 9, 10—approx. 300 to 400 bars This compressing sequence according to the invention is unique and provides the reliable reaction transmission obtained from the ignition charge to the delay charge.

The (first) delay charge 3 is ignited by a charge which projects with its central zone into the delay charge 3. The boundary surface between these two charges is designed in this arrangement preferably to have conical shapes to provide a transition zone between the charges.

The shape of this boundary surface requires that, for compressing the charge igniting the delay charge 3, a pressure pin is provided which has a concave shape at its end facing this charge, in correspondence with the configuration of this boundary surface.

In the manufacturing procedure of this invention, the casing 1 can be open at its rear or bottom end 13, in which case then, for covering the igniter or ignition charge 2, a cover foil is inserted conventionally in the casing 1. A further advantage of the charging process of this invention, however, resides in that the casing 1 is fashioned to be sealed at the rear end 13 from the beginning so that an absolutely secure seal is provided with respect to moisture, for example, for the sensitive igniter charge. In order to ensure also in this instance the perfect triggering of the igniter charge, for example by impact or friction at very small available forces, the casing bottom is fashioned in its central zone to be "foil-like". This is done automatically during the deep-drawing of the casing 1 by means of a correspondingly formed drawing die. The foil-like zone has a thickness of about 30 to about 80 μm.

The delay path can basically consist of a single charge, but preferably several separate series-arranged delay charges are provided. The rearmost, first delay charge 3 can basically be ignited directly by the igniter charge 2. The igniter charge 2 is preferably a friction charge which can be triggered, for example, by means of a primer pin penetrating the foil-like bottom region.

With a view toward improved functioning of the fuse element, especially at relatively low temperatures and in case of relatively high centrifugal forces due to high rotational velocities, the relay charge 8 is, however, disposed between the igniter charge 2 and the delay charge 3. The reaction velocity in this relay charge 8 is then chosen approximately so that it ranges in the middle between the reaction velocity of the igniter charge 2 and the delay charge 3. It is thus advantageously possible to "distribute" the change in reaction velocity from the igniter charge 2 to the delay charge 3 over two boundary surfaces whereby the respectively abrupt changes are approximately cut in half. In the concrete fuse element utilized under practical conditions, there is even a second relay charge 7 which is provided to still further reduce the jump-like changes at the boundary surfaces and thus to increase the reliability of ignition of the slowly burning delay charge.

The reliability of the fuse element is still further increased, according to another suggestion, in that also the first delay charge 3 is pressed together by means of the "concave" pressure die whereby an especially uniform compacting of this charge is obtained and damage to the surface of the previously pressed relay charge 8 is reliably avoided.

The casing 1 is sealed at the forward end 14 by first placing the aluminum shim 11 on the charge 10 and then conventionally flanging the rim of the casing 1, projecting therebeyond in the forward direction, against the shim 11. For providing a seal, especially against moisture, the layer 12 of a sealing varnish is then additionally applied.

The rear end 13 could be sealed in the same way, by first flanging over the rim of the casing 1 toward the inside, then inserting a sealing foil, and thereupon applying the charge 2 under pressure. However, the version described above is preferred, according to which the casing 1 is provided at its rear end with an integrally formed bottom exhibiting a centrally located foil-like zone 13' fashioned to be correspondingly thin-walled and having a thickness of about 30–80 μm. In this connection also the accompanying figure depicts the approximately spherical forward zone 15 as well as the adjoining truncated-cone region 16 of the boundary surface between the relay charge 8 and the delay charge 3.

Preferably, the compression pin used to effect compression of the delay charge 3 has an identical configuration as that of the compression pin used to effect compression of the relay charge 8. This has the additional advantage that the charge 3 has a very uniform density and that damages of the zones 15, 16 of charge 8 are prevented.

What is claimed is:

1. Method for manufacturing a fuse element with a cylindrical casing with a front and a rear end, in which at least one ignition charge and a delay section composed of one or more delay charges are arranged in layers one behind the other, and whereby the front end of the casing is designed as a detonating or flame-producing outlet, characterized in that in the casing, starting from its front end, first the ignition charge is pressed against the rear end of the casing and then the additional charges are pressed, whereby pressing of the charge that ignites a delay charge is accomplished with the aid of a compression pin with a concave pressing surface in such fashion that this charge extends with its central portion into a first delay charge.

2. Method according to claim 1, characterized in that, in addition, at least the first delay charge is also pressed by a compression pin with a concave pressing surface.

* * * * *